United States Patent [19]

Bertholdt et al.

[11] Patent Number: 4,756,768

[45] Date of Patent: Jul. 12, 1988

[54] METHOD FOR THE CHEMICAL DECONTAMINATION OF METALLIC PARTS OF A NUCLEAR REACTOR

[75] Inventors: Horst-Otto Bertholdt, Erlangen; Hans Hirning, Grossenseebach; Rudolf Papesch, Erlangen; Hubert Stamm, Nuremberg, all of Fed. Rep. of Germany

[73] Assignee: Kraftwerk Union Aktiengesellschaft, Mülheim, Fed. Rep. of Germany

[21] Appl. No.: 936,981

[22] Filed: Dec. 1, 1986

Related U.S. Application Data

[63] Continuation of Ser. No. 722,297, Apr. 11, 1985, abandoned.

[30] Foreign Application Priority Data

Apr. 12, 1984 [DE] Fed. Rep. of Germany ..... 3413868

[51] Int. Cl.[4] ..... G21F 9/28

[52] U.S. Cl. ..... 134/3; 134/28; 376/310

[58] Field of Search ..... 134/3, 28; 376/189, 376/201, 310, 313; 252/80, 626, 631

[56] References Cited

U.S. PATENT DOCUMENTS

| | | | |
|---|---|---|---|
| 3,013,909 | 12/1961 | Pancer et al. | 134/3 |
| 3,615,817 | 10/1971 | Jordan et al. | 134/3 |
| 3,873,362 | 3/1975 | Mihram et al. | 134/28 X |
| 4,123,324 | 10/1978 | Sanada et al. | 376/313 |
| 4,226,640 | 10/1980 | Bertholdt | 134/3 |
| 4,512,921 | 4/1985 | Anstine et al. | 134/3 X |

*Primary Examiner*—Arthur L. Corbin

*Attorney, Agent, or Firm*—Herbert L. Lerner; Laurence A. Greenberg

[57] ABSTRACT

Chemical decontamination of metallic parts of nuclear reactor installation in which an oxidative treatment with a permanganic acid solution is applied before dicarbonic acids are used for further treatment. Rinsing operations are eliminated and smaller amounts of dicarbonic acids needed. Also the primary system of the nuclear reactor no longer requires emptying before effecting decontamination treatment.

10 Claims, 2 Drawing Sheets

METHOD FOR THE CHEMICAL DECONTAMINATION OF METALLIC PARTS OF A NUCLEAR REACTOR

This application is a continuation of application Ser. No. 722,297 filed Apr. 11, 1985, now abandoned.

BACKGROUND OF THE INVENTION

1. Field of the Invention

The invention relates to a method for the chemical decontamination of metallic parts of nuclear reactor installations, in which first, an oxidative treatment with a permanganate solution is applied before dicarbonic acids are used for further treatment.

2. Description of the Prior Art

In the method known from German Patent No. 26 13 351 and U.S. Pat. No. 4,226,640, which has found acceptance in practice, an alkaline permanganate solution is used for the oxidative treatment of contaminated nuclear reactor components at a temperature of about 100° C. The components are subsequently flushed with demineralized water (deionate) before continuing with a citrate-oxalate solution which is adjusted with ammonia to a pH-value of 3.5. The solution contains an inhibitor as well as ethylenediamine tetraacetic acid. The inhibitor is iron-III formate.

The known method with its individual stages and in-between rinsing operations uses high chemical concentrations and the time of treatment is quite long. Also, the known method has not been applied to primary systems of nuclear reactors which would have to be practically emptied for this purpose and would have to be filled again after the treatment.

SUMMARY OF THE INVENTION

An object of the invention is to lower the radiation exposure of inspection and repair personnel by chemical decontamination of the primary system of nuclear reactors or of parts thereof, which chemical decontamination can be carried out at a lower cost. Only little secondary waste is produced in the chemical decontamination. This waste is eliminated in a radiation-proof manner.

With the foregoing and other objects in view, there is provided in accordance with the invention a method for the chemical decontamination of metallic parts of nuclear reactor installations in which an oxidative treatment with a permanganate solution is applied before dicarbonic acids are used for the further treatment, characterized by the feature that permanganic acid is used for the oxidative treatment.

Other features which are considered as characteristic for the invention are set forth in the appended claims.

Although the invention is illustrated and described herein as embodied in a method for the chemical decontamination of metallic parts of nuclear reactor installations, it is nevertheless not intended to be limited to the details shown, since various modification may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DESCRIPTION OF THE PREFERRED EMBODIMENT

Figure 1:
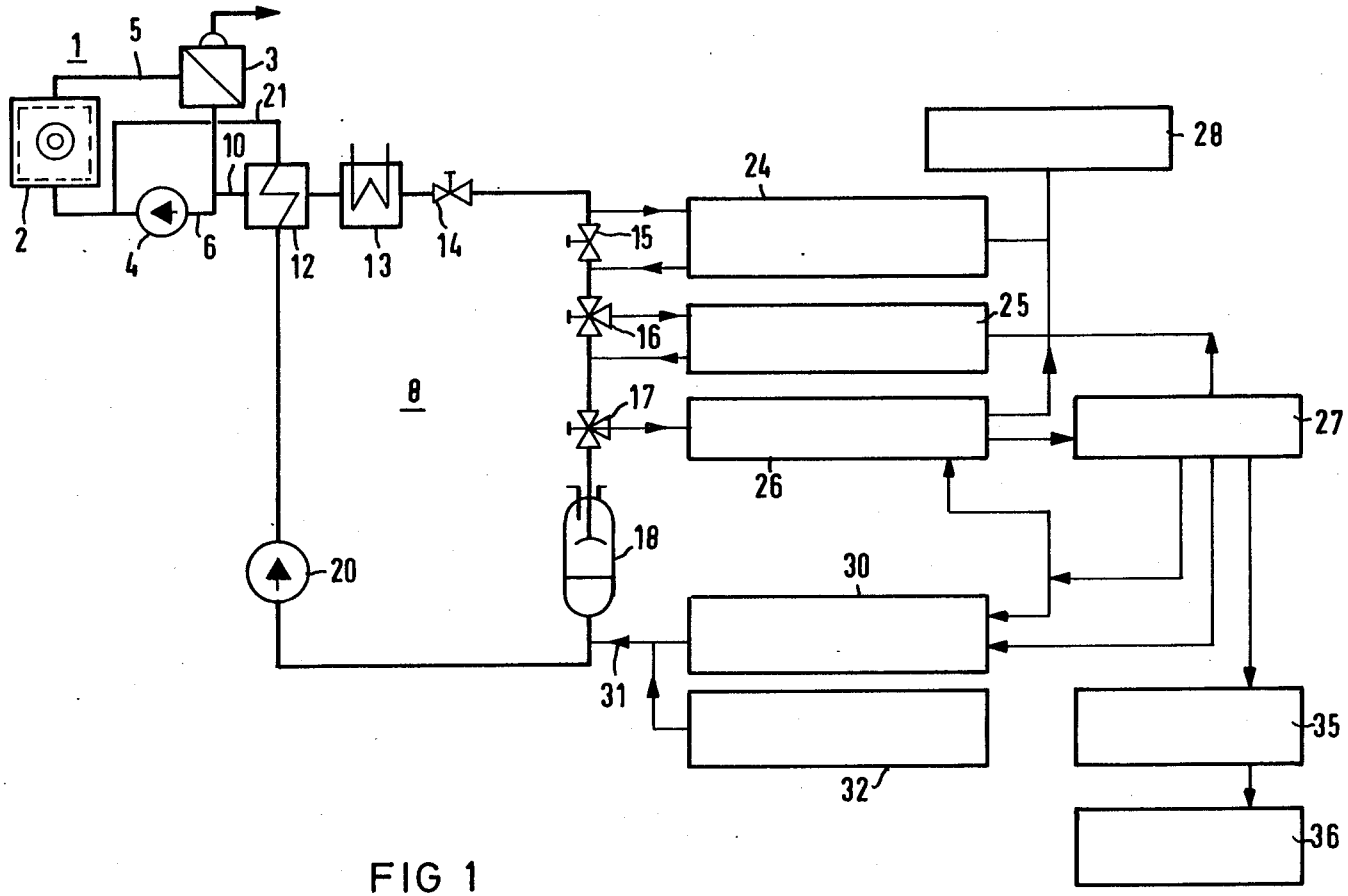
FIG. 1 shows the reactor cooling loop of a pressurized-water reactor which is to be decontaminated, and the auxiliary facilities the power station requires therefor.

In methods for the chemical decontamination of metallic parts of nuclear reactor installations, an oxidative treatment is applied with a permanganate solution before pickling with dicarbonic acids. According to the invention, permanganic acid which is preferably prepared by conversion of potassium permanganic acid, is used for the oxidative treatment. In light-water reactors, the permanganic acid can advantageously be added to the primary coolant. Thereafter, dicarbonic acids can be added directly to the acidified reactor coolant, which is then purified by the ion exchanger resins and remains in the nuclear reactor.

According to the invention, when using permanganic acid for the oxidative treatment, it was found that substantially lower concentrations will do for obtaining the same effect as with higher concentrations of alkaline permanganate in the known method. Also, for the subsequent treatment with dicarbonic or carboxylic acids, much smaller amounts of acid are sufficient, so that also correspondingly less secondary waste is produced. Very important however, the treatment can be carried out by adding the permanganic acid to the reactor coolant of a water-cooled nuclear reactor. Draining the reactor coolant is therefore no longer necessary. The new method can be conducted to purify the reactor coolant by ion exchanger resins and the purified reactor coolant remains in the nuclear reactor for further operation.

The permanganic acid is advantageously prepared by conversion of potassium permanganate. This can be done by removal of potassium by means of ion exchangers. The conversion of potassium permanganate to permanganic acid can be carried out outside the system during the decontamination of entire primary loops. The auxiliary systems available in the nuclear power generating station (such as reactor coolant purifiers) may, after oxidation be employed to remove manganese. The permanganic acid is present in a concentration range of 20 to 400 mg/kg.

An advantageous further development of the invention resides in the use of a mixture of dicarbonic acids with an oxalic acid content of at most $\frac{1}{3}$ of that used in the known method. Further dicarbonic acids of the mixture which can be used here are dicarbonic acids with a chain length of $C \geqq 3$ and hydroxy dicarbonic acids. The dicarbonic acids are added in particular for the purification of primary loops to the permanganic acid solution. The rinsing processes customary in the known process are thereby eliminated as well as the draining and disposing or reprocessing the permanganate solution.

With the method described above, a concentration of chemicals several times lower than in the known state of the art is obtained. Thereby, the danger of an undesirable attack on the base materials of the parts to be decontaminated is reduced correspondingly. In addition, the lower concentration of chemicals leads to smaller amounts of secondary waste. Nevertheless, despite the lower concentration of chemicals, large decontamination factors are achieved. Intermediate and final rinses can be eliminated altogether.

For a more detailed explanation of the invention, an embodiment example will be described in the following, making reference to the attached drawings.

Referring to FIG. 1, the pressurized-water reactor comprises with its primary loop 1, a reactor pressure vessel 2, a steam generator 3, and a reactor coolant pump 4. Coolant pump 4 returns the reactor cooling water which passes from the reactor pressure vessel 2 through the hot leg 5 into the steam generator 3, and back into the reactor pressure vessel 2 via the cold leg 6.

A volume control system 8 serves for treating the reactor cooling water. System 8 is connected to the cold leg 6 in the region between the pump 4 and the steam generator 3 by a discharge line 10. Reactor cooling water flowing through discharge line 10 runs via a recuperative heat exchanger 12 and a cooler 13 to a shutoff valve 14. This is followed by control valves 15, 16 and 17 which lead to a storage container 18. The coolant from the storage container 18 can be returned to the primary loop 1 by a high-pressure feed pump 20. In the process, the cooled and purified reactor coolant passes through the recuperative heat exchanger 12 in indirect heat exchange with reactor cooling water from discharge line 10, before it returns into the cold leg 6 via the line 21 behind the pump 4. Connected parallel to the valves 15 to 17 are devices for treating the coolant. They comprise a coolant purifier, for example anion/cation exchangers, indicated by 24 as well as a coolant degasifier 25. A coolant storage device 26 is provided for taking up surges and larger amounts of coolant. The devices 24 to 26 are connected, as is a coolant processor 27, to an exhaust gas system 28 commonly used for removal of gases, which receives the gaseous activity carriers produced in the coolant treatment, thereby relieving the coolant system of these undesired gaseous constituents.

Boron, which is used for controlling the burn-up, is removed in known manner from the coolant by the coolant processor 27. The boron and the boron-free deionate from coolant processor 27 can be fed to a boric acid and deionate feed 30, which feed discharges through a line 31 to the volume control system 8. A chemical feed 32 for the introduction of chemicals, e.g. an $HMnO_4$ solution, also leads into line 31. $HMnO_4$ solution may also be generated in feed source 30. Doses of a dicarbonic acid mixture known in the art and shown for example in U.S. Pat. No. 4,226,640, may be fed from chemical feed source 32 or feed source 30 and then discharged through line 31 into volume control system 8. If needed, make-up boron as boric acid may also be introduced into feed 30 or directly into line 31.

The liquid wastes produced in the coolant purifier 27 can be passed on to a treatment plant 35 for conventional treatment of radioactive liquid waste to produce radioactive concentrates. This is followed by known treatment of the radioactive concentrates indicated at 36 to make the radioactive concentrates suitable for ultimate storage.

The following process cycle with individual steps illustrates the conditions of the operation for the decontamination of the primary loop:

1.1 Primary loop 1 with reactor coolant pump 4 in operation; temperature in cold leg 6 about 90° C., $p \approx 30$ bar, boron concentration in the reactor coolant, 2200 mg/kg.

1.2 Starting the $HMnO_4$ solution in the boric acid preparation container of the boric acid and deionate feed 30.

1.3 Adding doses of $HMnO_4$ in the reactor coolant up to a concentration of about 50 mg/kg.

1.4 Raising the temperature of the primary loop 1 to 100° C.

1.5 Oxidation treatment through circulation by the reactor coolant pump 4; 5 hours.

1.6 Lowering the temperature to 50° to 60° C.

1.7 Starting the dicarbonic acid mixture, for instance, in the boric acid starting container of the boric acid and deionate feed 30.

1.8 Adding doses of the dicarbonic acids; degassifier 25 is in operation with maximum output.

1.9 Final concentration about 300 to 400 mg/kg for the total of the dicarbonic acids.

2.0 Raising the temperature of the primary loop 1 to 100° C.

2.1 Starting up the coolant purifier 24.

2.2 Removal of the dissolved cations (activity) as well as of the dicarbonic acids by means of anion/cation exchangers.

2.3 Primary coolant purified.

2.4 If required, repetition of the process 1.2 and 2.3 (second cycle).

2.5 If required, repetition of the process 1.2 to 2.3 (third cycle).

Figure 2:
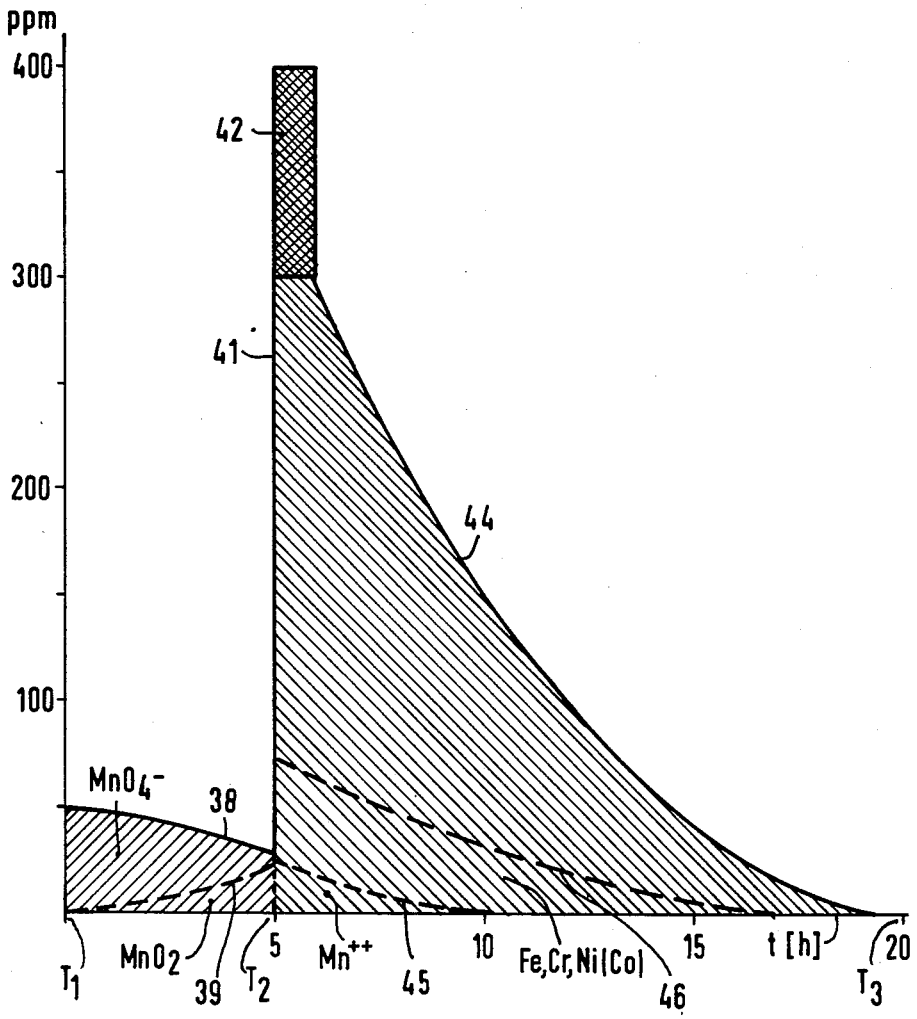
FIG. 2 shows the course in time of the decontamination treatment for a first cycle.

In FIG. 2, the concentration of the chemicals is shown in ppm on the ordinate for an individual cycle. The abscissa is the time axis with a maximum value of 20 hours.

Starting with a permanganate concentration of 50 ppm starting at the time $T_1$ by feeding permanganic acid into the primary loop, an oxidative treatment takes place which leads to a loosening of the structure of the oxide layer caused by the contamination. This process is indicated by the curve 38. It shows a slightly decreasing concentration of $MnO_4$ and a rise of the $MnO_2$ content indicated by the dashed curve 39.

After 5 hours, the temperature in the primary system is lowered at the time $T_2$ to $\leqq 60°$ C. and the dicarbonic acid mixture is added directly to the permanganic acid solution. These are dicarbonic acids or hydroxy-dicarbonic acids which are added up to a concentration of 300 mg/kg in the primary coolant, as is shown by the curve portion 41, as well as another 100 mg/kg parts oxalic acid, as the part 42 of the curve is to show. Examples of dicarbonic acids which may be used are, for instance, mesoxalic, malonic acid, dihydroxyfumeric acid and dihydroxytartaric acid. During the addition the $HMnOP_4$ and $MnO_2$ present in the system react with the oxalic acid and are reduced to $Mn^{++}$ ions. The oxalic acid is oxidized here to $CO_2$, and the $CO_2$ is discharged via the degassifier, which latter in a simple form may be an enclosed vessel into which the liquid-gas mixture is introduced and wherein the liquid settles as a lower layer with the gas as an upper layer above it. The separated upper gas layer is sent to an exhaust gas system.

After the completion of the $HMnO_4$ oxalic acid reaction, the content of the primary loop is again heated to 100° C. Parts of the primary coolant are then routed shunt-wise over ion exchanger filters which are part of the coolant purifier 24 and the coolant processor 27. Thus, the facilities already present in the power station are used. In the course of 20 hours up to the time $T_3$, the concentration of chemicals can be run down to practically zero (curve 44). In the process the manganese content stemming from the oxidative reaction is reduced, as is indicated by the dashed curve portion 45. At the same time, however, the components of the oxide layer are filtered out. This happens in accordance with the curve 46 which shows the content of iron, chromium, nickel and possibly cobalt. The removal of the cations and the dicarbonic acid via the ion exchangers is controlled here so that the dicarbonic acid, equivalent to the dissolved cations, is present in excess. This is a decisive factor for preventing reprecipitation of the dissolved activity.

There is claimed:

1. Method for the chemical decontamination of metallic parts of nuclear reactor installations which comprises subjecting the contaminated metallic surface to oxidative treatment by flowing an aqueous solution of permanganic acid in contact with the contaminated metallic surface and, without rinsing the metallic surface with demineralized water, subjecting the oxidative treated metallic surface to additional treatment with dicarbonic acids by flowing an aqueous solution of dicarbonic acids in contact with the metallic surface.

2. Method according to claim 1, wherein the permanganic acid is prepared by the conversion of permanganate salts.

3. Method according to claim 2, wherein the permanganate salt is potassium permanganate.

4. Method according to claim 2, wherein the conversion takes place outside of the parts to be decontaminated as well as during the decontamination treatment.

5. Method according to claim 4, wherein the permanganic acid is used in the range of concentrations from 20 to 400 mg/kg.

6. Method according to claim 1, wherein said dicarbonic acids are a mixture of dicarbonic acids, wherein one component of the mixture of dicarbonic acids is oxalic acid, and wherein not more than $\frac{1}{3}$ of the content of the mixture of dicarbonic acids is the oxalic acid.

7. Method according to claim 6, wherein the mixture of dicarbonic acids with oxalic acid also contains hydroxydicarbonic acids as well as dicarbonic acids with a chain length of at least 3 carbons.

8. Method according to claim 1, wherein after said oxidative treatment, the dicarbonic acids are added directly to the permanganic acid solution.

9. Method according to claim 1, wherein the permanganic acid is added to the reactor coolant of a water-cooled nuclear reactor.

10. Method according to claim 9, wherein the reactor coolant is purified by ion exchanger resins and the purified reactor coolant remains in the nuclear reactor for continued operation.

* * * * *